US009597890B1

(12) United States Patent
Murphy et al.

(10) Patent No.: US 9,597,890 B1
(45) Date of Patent: Mar. 21, 2017

(54) APPARATUS FOR A PRINTER SYSTEM

(71) Applicant: HEWLETT-PACKARD DEVELOPMENT COMPANY, L.P., Houston, TX (US)

(72) Inventors: Bryan Murphy, Leixlip (IE); Ben Smith, Leixlip (IE); Willie Sheehan, Leixlip (IE); William Black, Leixlip (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/090,287

(22) Filed: Apr. 4, 2016

(51) Int. Cl.
*B41J 2/175* (2006.01)
*B41J 2/14* (2006.01)

(52) U.S. Cl.
CPC ..... *B41J 2/17596* (2013.01); *B41J 2/17563* (2013.01); *B41J 2002/14306* (2013.01)

(58) Field of Classification Search
CPC ..... B41J 2002/14306; B41J 2/17563; B41J 2/17596; B41J 2202/07; B41J 2/055
See application file for complete search history.

(56) References Cited

U.S. PATENT DOCUMENTS

| | | | | |
|---|---|---|---|---|
| 6,533,404 | B1 * | 3/2003 | Olsen | B41J 2/17523 347/92 |
| 7,628,475 | B2 | 12/2009 | Langford et al. | |
| 7,988,265 | B2 | 8/2011 | Smith | |
| 8,454,137 | B2 | 6/2013 | Price et al. | |
| 8,721,028 | B2 | 5/2014 | Petruchik et al. | |
| 8,905,528 | B2 | 12/2014 | Hochreiter | |
| 2006/0090645 | A1 * | 5/2006 | Kent | A61M 1/1658 95/46 |
| 2015/0053268 | A1 * | 2/2015 | Murphy | B41J 2/17523 137/1 |

* cited by examiner

*Primary Examiner* — Henok Legesse
(74) *Attorney, Agent, or Firm* — Tarolli, Sundheim, Covell & Tummino L.L.P.

(57) ABSTRACT

An apparatus, such as a flow restriction apparatus, is provided. The flow restriction apparatus includes an ink outlet perforating through a tank wall of a printing fluid reservoir of a user-refillable inkjet printer system. The ink outlet facilitates fluid communication between the printing fluid reservoir and an inkjet pen of the printer system. Printing fluid from the printing fluid reservoir enters the ink outlet from the printing fluid reservoir under suction pressure exerted by the inkjet pen. A screen is located inside the printing fluid reservoir and separates the printing fluid reservoir from the ink outlet. The screen is ink permeable. The screen includes a screen aperture having an effective radius smaller than a meniscus of a droplet of printing fluid at atmospheric pressure within the printing fluid reservoir.

14 Claims, 3 Drawing Sheets

APPARATUS FOR A PRINTER SYSTEM

BACKGROUND

Inkjet printing technology is used in many commercial products such as computer printers, graphics plotters, copiers, and facsimile machines. One type of inkjet printing, known as "drop on demand," employs at least one inkjet pen that ejects drops of ink onto a print medium such as a sheet of paper. Printing fluids other than ink, such as preconditioners and fixers, can also be utilized. The pen or pens are typically mounted to a movable carriage that traverses back-and-forth across the print medium. As the pens are moved repeatedly across the print medium, they are activated under command of a controller to eject drops of printing fluid at appropriate times. With proper selection and timing of the drops, the desired pattern is obtained on the print medium.

An inkjet pen generally includes at least one fluid ejection device, commonly referred to as a printhead, which has a plurality of orifices or nozzles through which the drops of printing fluid are ejected. Adjacent to each nozzle is a firing chamber that contains the printing fluid to be ejected through the nozzle. Ejection of a fluid drop through a nozzle may be accomplished using any suitable ejection mechanism, such as thermal bubble or piezoelectric pressure wave. Capillary action causes the firing chamber to refill after drop ejection, drawing ink from the reservoir. An inkjet pen typically includes a pen supply line that delivers printing fluid from the printing fluid reservoir to the printhead.

DETAILED DESCRIPTION

Figure 1:
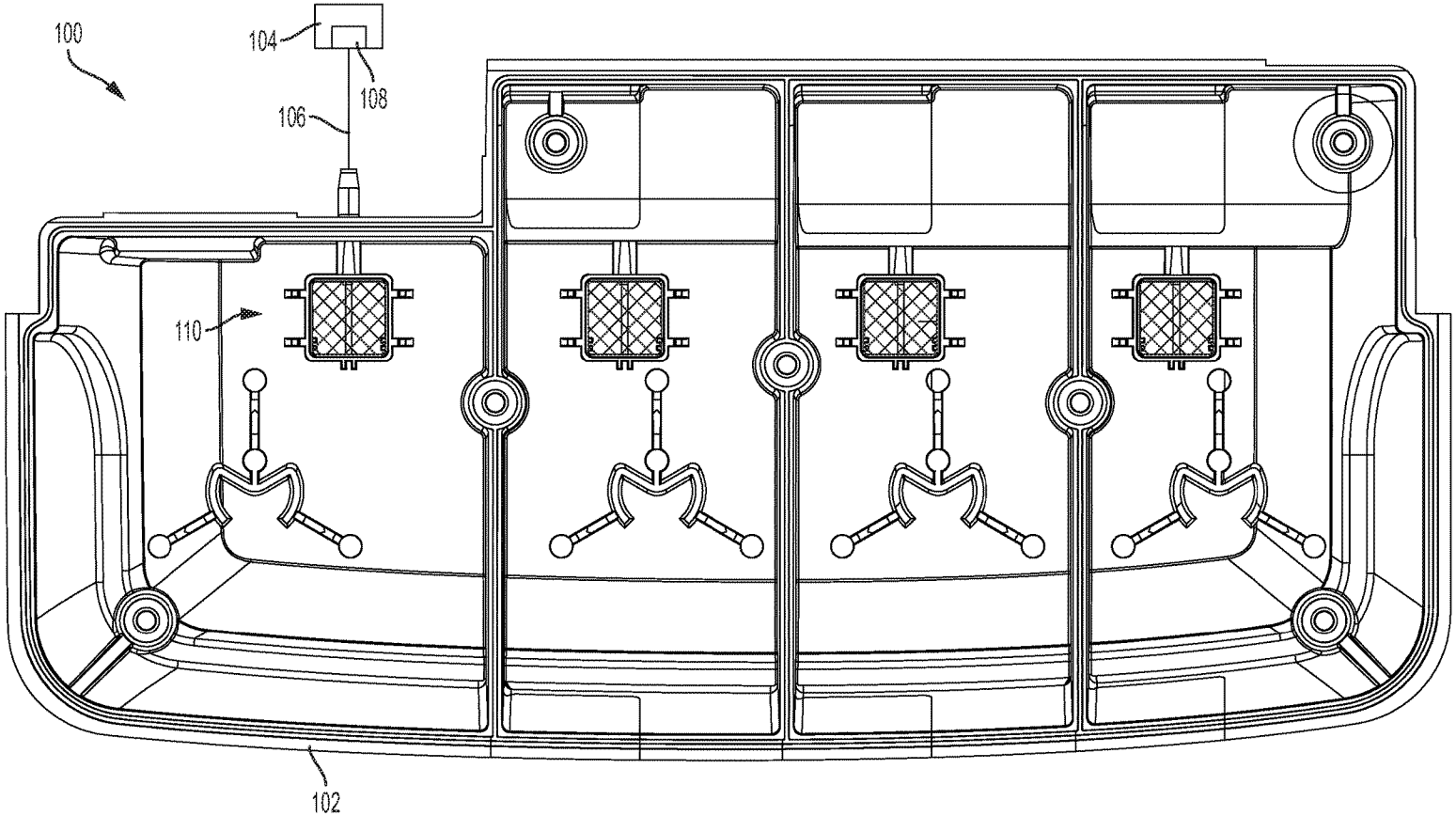
FIG. 1 schematically illustrates an example of a flow restriction apparatus.
Figure 2:
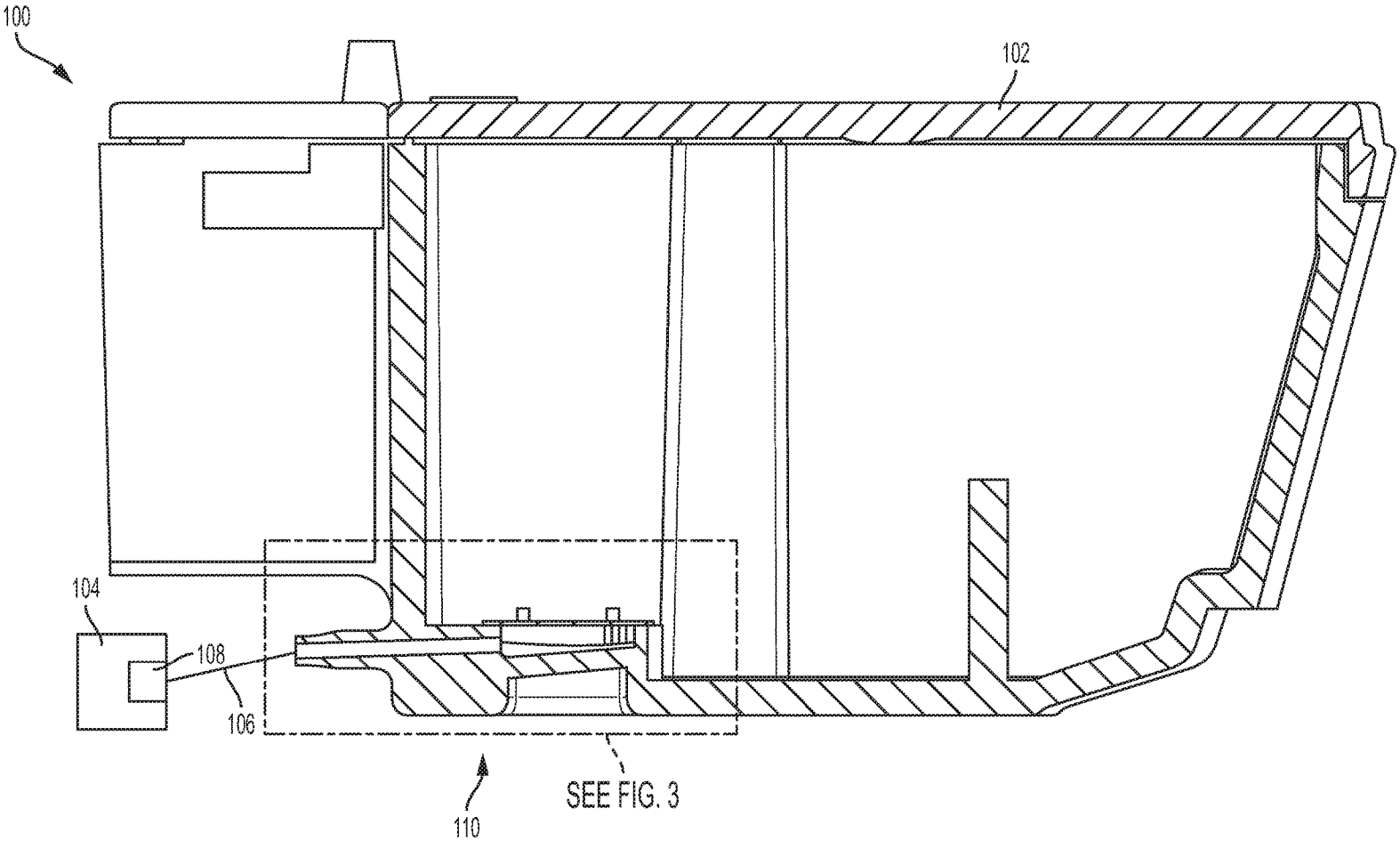
FIG. 2 schematically illustrates the example flow restriction apparatus of FIG. 1.

FIGS. 1-2 illustrate a printer system 100, including a printing fluid reservoir 102 (four shown). As used herein, the term "printer system" is intended to encompass any system or device that prints on a print medium (i.e., produces hard copy). Such devices include, but are not limited to, computer printers, graphics plotters, copiers, facsimile machines and the like. Furthermore, the term "inkjet printer system", and related language, refers to any system or device that uses inkjet technology for producing hard copy.

The printing fluid reservoir(s) 102 are shown as being of the user-refillable "off axis" type for use with an inkjet printer system but may be any suitable printing fluid reservoir type. The below discussion and remaining Figures are directed to the leftmost, numbered printing fluid reservoir 102 for clarity, but the described technology may be used with any printing fluid reservoir 102. An inkjet pen (shown schematically at 104) has a pen supply line 106 in fluid communication with the printing fluid reservoir 102 and a printhead (shown schematically at 108) in fluid communication with the pen supply line 106.

Figure 3:
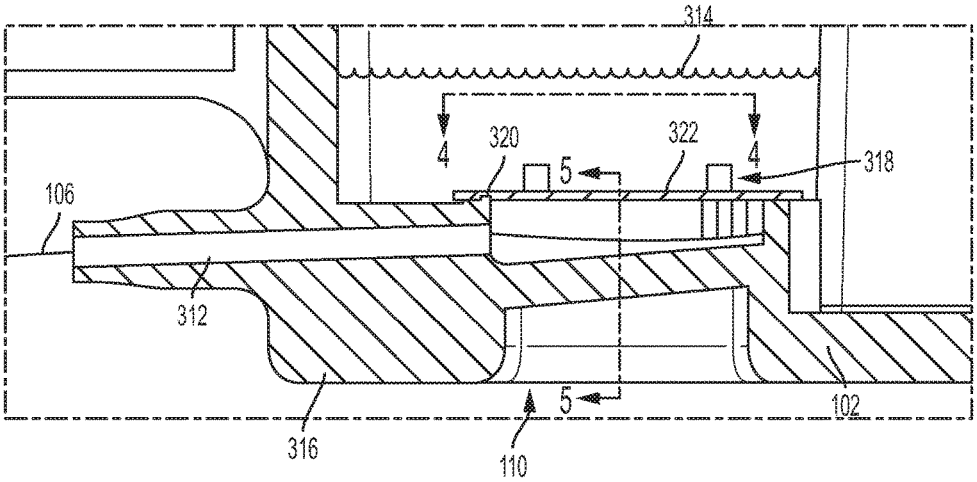
FIG. 3 is a schematic detail view of area "3" in FIG. 2.
Figure 4:
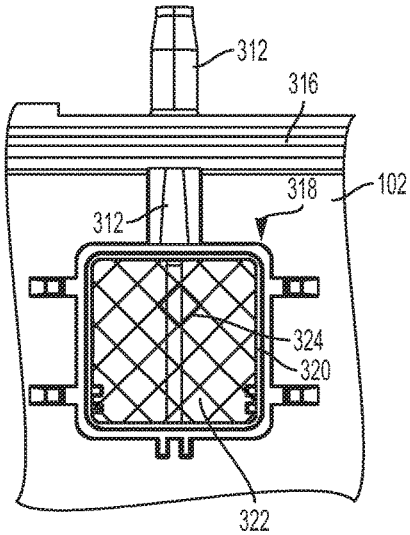
FIG. 4 is a schematic partial plan view taken along line "4-4" in FIG. 3.
Figure 5:
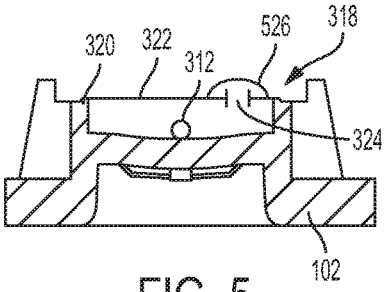
FIG. 5 is a schematic partial side view taken along line "5-5" in FIG. 3.

The printer system 100 also includes an apparatus, such as a flow restriction apparatus 110. As shown in the detail views of FIGS. 3-5, an ink outlet 312 places the printing fluid reservoir 102 in fluid communication with the pen supply line 106. Printing fluid 314, contained within the printing fluid reservoir 102, enters the ink outlet 312 from the printing fluid reservoir 102 under suction pressure exerted by the inkjet pen 104. As used herein, the term "printing fluid" refers to any fluid used in a printing process, including but not limited to inks, preconditioners, fixers, etc., but will be referenced herein as being fluid ink. Egress of printing fluid 314 from the inkjet pen 104 generates the suction pressure exerted by the inkjet pen 104 during the printing process, thus leaving a void in the pen supply line 106 which responsively draws printing fluid 314 from the printing fluid reservoir 102 via the ink outlet 312. The printer system 100 described herein is not of the type that includes a priming pump (e.g., an inline pump and/or a suction/vacuum feature) along the printing fluid 314 travel path between the printing fluid reservoir 102 and the printhead 108 for exerting pump force on the printing fluid 314 and/or air within the printing fluid reservoir 102, ink outlet 312, pen supply line 106, or inkjet pen 104. Instead, by omitting a pump, the present printer system 100 avoids user delays and wasted printing fluid 314 due to depriming interventions. The printer system 100 disclosed herein instead strongly reduces or even substantially obviates the need for a priming pump, depending upon the particular printer system design, by avoiding passage of air from the printing fluid reservoir 102 into the ink outlet 312 and pen supply line 106. However, even if a priming pump were to be included in the printer system 100, pumping/priming interventions for the printer system 100 may be performed relatively infrequently due to the avoidance of air entry into unwanted areas of the system, as will be discussed below.

The ink outlet 312 perforates through a tank wall 316 of the printing fluid reservoir 102 and places the printing fluid reservoir 102 in fluid communication with the inkjet pen 104. Printing fluid 314 enters the ink outlet 312 from the printing fluid reservoir 102, as previously mentioned, under suction pressure exerted by the inkjet pen 104. The ink outlet 312 can be an elongated pipe, as shown in the Figures, can be a simple aperture or hole in the tank wall 316, or can have any other suitable configuration for a particular use environment. A standpipe 318 may be located inside the printing fluid reservoir 102 and, when present, may restrict access of printing fluid 314 to the ink outlet 312 for any desired reason, including, but not limited to, avoiding pen supply line 106 intake of sediment on the bottom of the tank, preventing overshoot at the printhead 108 end of a high flow rate printing fluid 314 path, and controlling fluid dynamics at/near the ink outlet 312. When present, the standpipe 318 may have a horizontally-oriented standpipe outlet 320 facilitating fluid communication between the printing fluid reservoir 102 (that is, the portion of the printing fluid reservoir 102 outside the standpipe 318) and the ink outlet 312.

The phrase "horizontally-oriented" is used herein to indicate that the standpipe outlet 320 (a "mouth" or "rim" of the standpipe 318) is substantially located within a horizontal plane, for reasons which will be discussed below. However, it is also contemplated that the standpipe outlet 320, and associated structures, may be placed in orientations other than horizontal, such as angled from the horizontal, even to the extent of a completely vertical orientation. Particularly in the case of a non-horizontal standpipe outlet 320 and/or related structure, the printing fluid 314 may merely partially submerge the standpipe outlet 320 or related structure during use.

The description and Figures herein also depict the printing fluid 314 level as gradually sinking down to a level of the upward-facing standpipe outlet 320. However, it is also contemplated that the standpipe outlet 320, ink outlet 312, or any other inkflow-related portion of the printer system, may draw in printing fluid 314 in any desired manner, including drawing printing fluid 314 upward from a lower portion of the printing fluid reservoir 102, such as via suction and/or capillary action. When the printing fluid 314 within the printing fluid reservoir 102 has been depleted to a point (e.g., a level of printing fluid 314 that is at least one of level with, and below the level of, the ink outlet 312) that further printing fluid 314 is effectively unavailable for printing use, the printing fluid reservoir 102 is considered to be "empty", even if there is actually a very small, even minuscule, amount of printing fluid 314 remaining within the printing fluid reservoir 102.

The flow restriction apparatus 110 also includes a screen 322 located inside the printing fluid reservoir 102. The screen 322 separates the printing fluid reservoir 102 from the ink outlet 312 such that printing fluid 314 added to the printing fluid reservoir 102 must pass through the screen 322 before exiting the printing fluid reservoir 312 through the ink outlet 312. The screen 322 is ink permeable. The screen 322 includes a screen aperture (one of which is numbered as 324 in FIG. 4) having an effective radius—i.e., an opening maximum dimension—smaller than a meniscus of a droplet (shown schematically at 526 in FIG. 5) of printing fluid 314 at atmospheric pressure within the printing fluid reservoir 102. The screen 322 may be, for example, a perforated piece of stainless steel, stainless steel fibers, polymer fibers, polymer mesh, or may be any other porous membrane or sheet structure, though will have an affinity for ink wetting and chemical inertness to the printing fluid 314, for most use environments. The screen may include a plurality of screen apertures 324.

When the screen 322 is wetted with printing fluid 314, the screen 322 is air impermeable under the suction pressure exerted by the inkjet pen 104. (The term "wetted" is used herein to indicate that sufficient free ink is available in fluid communication with the screen 322 to readily form meniscii on the screen apertures 324.) In this manner, the screen 322, serving as a portion of the flow restriction apparatus 110, prevents entry of air into the ink outlet 312 (and subsequent depriming of the pen supply line 106) when the printing fluid 314 level in the printing fluid reservoir 102 falls below an amount at which further printing fluid 314 can be provided to the ink outlet 312. This process will now be described in more detail.

For example, when the screen 322 is located at a vertical level of the standpipe outlet 320, as shown in the Figures, the volume of printing fluid 314 within the printing fluid reservoir 102 at a higher level than the screen 322 may exert a gravity-imposed head pressure on the screen 322 that pushes the ink through the screen 322, such as through a screen aperture 324, and the printing fluid 314 then flows into the ink outlet 312. Printing fluid 314 may also be freely provided to a standpipe outlet 320 even after the level of printing fluid 314 within the printing fluid reservoir 102 falls below the level of the screen 322 via "wicking" or capillary action drawing printing fluid 314 up from the portions of the printing fluid reservoir 102 below the level of the standpipe outlet 320.

Because any air trapped within the printing fluid 314 volume tends to "bubble up" and not be sucked into the ink outlet 312, there is not a substantial risk of depriming—allowing entrance of unwanted air into the pen supply line 106—as long as there is a predetermined amount of printing fluid 314 in the printing fluid reservoir 322 available to the screen 322. As used herein, "available" printing fluid 314 includes both printing fluid 314 drawn up onto an elevated (above the floor of the printing fluid reservoir 102) screen 322 atop a standpipe 318 or other structure, as well as printing fluid 314 which flows down onto the screen 322 from a higher location within the printing fluid reservoir 102.

However, when the printing fluid 314 is consumed to the point that the printing fluid 314 is not freely available the screen 322 (as it normally is during printing, via direct supply and/or wicking), then the printing fluid 314 merely wets the screen 322 and air becomes present atop the screen 322. Capillary action from the pen supply line 106 (or related structures) is no longer sufficient to pull the printing fluid 314 through the screen, and there normally may be an increased risk of the pen supply line 106 "sucking air" from the printing fluid reservoir 102 and becoming undesirably deprimed. With the flow restriction apparatus 110, though, suction pressure exerted by the inkjet pen 104 and tending to draw printing fluid 314 into the ink outlet 312 is resisted by a bubble pressure of the meniscii formed by the printing fluid 314 droplets 526 wetting the screen 322. Each screen aperture 324 has an effective radius or pore size selected to resist passage of air through the screen apertures 324 under the suction pressure exerted by the inkjet pen 104. For example, one screen aperture 324 might have a pore size (e.g., effective radius) in the range of about 5-9 μm, more specifically about 7 μm. Other factors affecting the bubble pressure and thus air passage resistance include the contact angle between the printing fluid 314 and the material of the screen 322, the viscosity of the printing fluid 314, the surface tension of the printing fluid 314, and the like. The screen aperture 324 will have an effective radius dependent at least partially upon the specific properties of the printing fluid 324, and may be specified for a particular use environment with reference to those properties. This resistance to air passage by the effective radii of the screen apertures 324 occurs cooperatively with a bubble pressure of the meniscii formed by droplets 526 of printing fluid 324. The term "cooperatively" is used herein to indicate that the "cooperative" property involves the joint activity of two or more actors in the system.

Stated differently, when a level of printing fluid 314 in the printing fluid reservoir 102 drops down, due to ink consumption, to a predetermined "empty" level, the screen 322 will be merely wetted by droplets 526 of printing fluid 314. The amount of suction pressure which is exerted by the inkjet pen 104 is lower than the resistance of the meniscii of the droplets 526 of printing fluid 314 to that pressure. Accordingly, the effective radius, or other maximum "open" dimension, of the screen aperture 324 is chosen to be smaller than a meniscus of a droplet 526 of printing fluid 314 in "free space" (i.e., not acting as an element of a larger volume of printing fluid 314) within the printing fluid reservoir 102. That is, the droplet 526 of printing fluid 314 is merely wetting the screen 322, rather than being part of a relatively freely-flowing supply of printing fluid 314 which is available for use by the printhead 108. The bubble pressure of the printing fluid 314 droplet 526 thus "caps" or blocks the screen aperture 324, as shown schematically by the bridging droplet 526 in FIG. 5, to prevent passage of air through the screen 322. It is also contemplated that the meniscus of the droplet 526 of printing fluid 314 may span or bridge the screen aperture 324, contacting the sidewalls of the screen aperture 324 itself, thus being located substantially within the plane of the screen 322. The suction pressure exerted by the inkjet pen 104 is insufficient to overcome the bubble pressure and suck those last few "wetting" droplets 526 of printing fluid 314 through the screen 322, thereby opening the screen aperture 324 to the unwanted passage of air therethrough.

The flow restriction apparatus 110 accordingly prevents entrance of air into the ink outlet 312, since the screen 322 is air impermeable when a level of printing fluid 314 in the printing fluid reservoir 102 is at least one of level with, and below the level of, the screen 314. The printer system 100 may then cease operation and/or alert the user (such as via providing pages missing the color of printing fluid 314 that has "run out" or in any other suitable manner) that the level of printing fluid 314 in the printing fluid reservoir 102 is insufficient to provide ink to the inkjet pen 104, thus prompting the user to refill the printing fluid reservoir 102.

When the printing fluid reservoir 102 includes a standpipe 318, as shown in the Figures, the screen 322 may wholly cover the standpipe outlet 320, such as by being heat-staked or otherwise secured to an entire circumference of the standpipe outlet 320. Otherwise, when no standpipe 318 is present, the screen 322 may be placed directly over the ink outlet 312 in the tank wall 316. It is contemplated, though, that whether or not a standpipe 318 is present, the screen 322 will be exposed to the printing fluid 314 within the printing fluid reservoir 102 as the printing fluid 314 is consumed to the level of the screen 322. For example, when the screen 322 is horizontally oriented within the printing fluid reservoir 102, the standpipe 318 may contain printing fluid 314 up to a level of the screen 322. That is, because of the flow of printing fluid 314 under gravity, the top surface of the printing fluid 314 within the standpipe 318 may be effectively level with the horizontally oriented screen 322, in this situation The screen 322 is air impermeable when a level of printing fluid 314 in the printing fluid reservoir 102 is substantially level with, and/or falls below, the level of the screen 322 within the printing fluid reservoir 102 to a point where the printing fluid reservoir 102 is considered "empty" of usable printing fluid 314.

Relative terms used to describe the structural features of the figures illustrated herein, such as above and below, up and down, first and second, near and far, etc., are in no way limiting to conceivable implementations. For instance, where examples of the structure described herein are described in terms consistent with the figures being described, and actual structures can be viewed from a different perspective, such that above and below may be inverted, e.g., below and above, or placed on a side, e.g., left and right, etc. Such alternatives are fully embraced and explained by the figures and description provided herein.

What have been described above are examples. It is, of course, not possible to describe every conceivable combination of components or methods, but one of ordinary skill in the art will recognize that many further combinations and permutations are possible. Accordingly, the invention is intended to embrace all such alterations, modifications, and variations that fall within the scope of this application, including the appended claims. Additionally, where the disclosure or claims recite "a," "an," "a first," or "another" element, or the equivalent thereof, it should be interpreted to include one or more than one such element, neither requiring nor excluding two or more such elements. As used herein, the term "includes" means includes but not limited to, and the term "including" means including but not limited to. The term "based on" means based at least in part on.

What is claimed is:

1. An apparatus, comprising:

an ink outlet perforating through a tank wall of a printing fluid reservoir of a user-refillable inkjet printer system, the ink outlet facilitating fluid communication between the printing fluid reservoir and an inkjet pen of the printer system, printing fluid from the printing fluid reservoir entering the ink outlet from the printing fluid reservoir under suction pressure exerted by the inkjet pen; and a screen located inside the printing fluid reservoir and separating the printing fluid reservoir from the ink outlet, the screen being ink permeable;

wherein the screen includes a screen aperture having an effective radius smaller than a meniscus of a droplet of printing fluid at atmospheric pressure within the printing fluid reservoir, wherein, when the screen is wetted with printing fluid, the screen is air impermeable under the suction pressure exerted by the inkjet pen.

2. The apparatus of claim 1, wherein the screen includes a plurality of screen apertures having an effective radius selected to, cooperatively with a bubble pressure of the meniscii formed by printing fluid wetting the apertures, resist passage of air therethrough under the suction pressure exerted by the inkjet pen.

3. The apparatus of claim 1, including a standpipe located inside the printing fluid reservoir and restricting access of printing fluid to the ink outlet.

4. The apparatus of claim 3, wherein the standpipe has a standpipe outlet facilitating fluid communication between the printing fluid reservoir and the ink outlet, the screen wholly covering the standpipe outlet.

5. The apparatus of claim 4, wherein the screen is horizontally oriented within the printing fluid reservoir, the standpipe contains printing fluid up to a level of the screen, and the screen is air impermeable when a level of printing fluid in the printing fluid reservoir is at least one of level with, and below the level of, the screen.

6. The apparatus of claim 1, wherein suction pressure exerted by the inkjet pen is resisted by a bubble pressure of the meniscii formed by printing fluid wetting the screen to prevent passage of air through the screen when a level of printing fluid in the printing fluid reservoir is at least one of level with, and below the level of, the screen.

7. The apparatus of claim 1, wherein egress of printing fluid from the inkjet pen during the printing process generates the suction pressure exerted by the inkjet pen.

8. A printer system comprising:

a printing fluid reservoir;

an inkjet pen having a pen supply line in fluid communication with the printing fluid reservoir and a printhead in fluid communication with the pen supply line; and a flow restriction apparatus including:

an ink outlet facilitating fluid communication between the printing fluid reservoir and the pen supply line, printing fluid entering the ink outlet from the printing fluid reservoir under suction pressure exerted by the inkjet pen, and a screen located inside the printing fluid reservoir and separating the printing fluid reservoir from the ink outlet, the screen being ink permeable and the screen including a screen aperture having an effective radius smaller than a meniscus of a droplet of printing fluid at atmospheric pressure within the printing fluid reservoir such that, when the screen is wetted with printing fluid, the screen is air impermeable under the suction pressure exerted by the inkjet pen.

9. The printer system of claim 8, wherein the screen includes a plurality of screen apertures having an effective radius selected to, cooperatively with a bubble pressure of the meniscii formed by printing fluid wetting the apertures, resist passage of air therethrough under the suction pressure exerted by the inkjet pen.

10. The printer system of claim 8, including a standpipe located inside the printing fluid reservoir and, in cooperation with the ink outlet, facilitating fluid communication between the pen supply line and the printing fluid reservoir.

11. The printer system of claim 10, wherein the standpipe has a standpipe outlet facilitating fluid communication between the printing fluid reservoir and the ink outlet, the screen wholly covering the standpipe outlet.

12. The printer system of claim 8, wherein suction pressure exerted by the inkjet pen is resisted by a bubble pressure of the meniscii formed by the printing fluid wetting the screen to prevent passage of air through the screen when a level of printing fluid in the printing fluid reservoir is at least one of level with, and below the level of, the screen.

13. The printer system of claim 8, wherein the screen is horizontally oriented within the printing fluid reservoir, the standpipe contains printing fluid up to a level of the screen, and the screen is air impermeable when a level of printing fluid in the printing fluid reservoir is at least one of level with, and below the level of, the screen.

14. The printer system of claim 8, wherein egress of printing fluid from the inkjet pen generates the suction pressure exerted by the inkjet pen during the printing process.

* * * * *